US009856704B2

(12) United States Patent
Montiel et al.

(10) Patent No.: US 9,856,704 B2
(45) Date of Patent: Jan. 2, 2018

(54) TELESCOPING SLIP JOINT ASSEMBLY

(71) Applicant: Schlumberger Technology Corporation, Sugar Land, TX (US)

(72) Inventors: Edgar Jose Montiel, Richmond, TX (US); Michael Gratzinger, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/859,858

(22) Filed: Sep. 21, 2015

(65) Prior Publication Data

US 2016/0084019 A1 Mar. 24, 2016

Related U.S. Application Data

(60) Provisional application No. 62/053,307, filed on Sep. 22, 2014.

(51) Int. Cl.
*E21B 17/07* (2006.01)
*E21B 17/00* (2006.01)

(52) U.S. Cl.
CPC ..... *E21B 17/07* (2013.01); *E21B 17/00* (2013.01)

(58) Field of Classification Search
CPC ..... E21B 17/00; E21B 17/07
See application file for complete search history.

(56) References Cited

U.S. PATENT DOCUMENTS 1,524,677 A * 2/1925 Thompson ..... E21B 17/07 248/161
1,844,257 A * 2/1932 Lincoln ..... E21B 17/07 464/18
2,245,638 A * 6/1941 Baker ..... E21B 17/07 166/131
2,373,280 A * 4/1945 Weber ..... F16L 27/12 277/621
2,937,007 A * 5/1960 Whittle ..... E21B 4/02 175/107

(Continued)

FOREIGN PATENT DOCUMENTS

GB 2032494 A * 5/1980 ..... E21B 17/003
GB 2141508 A * 12/1984 ..... E21B 17/00
WO 02-25051 A2 3/2002

OTHER PUBLICATIONS

International Search Report issued in related PCT application PCT/US2015/051316 dated Nov. 17, 2015, 4 pages.

(Continued)

*Primary Examiner* — James G Sayre
(74) *Attorney, Agent, or Firm* — Tuesday Kaasch

(57) ABSTRACT

A slip joint assembly that is usable with a well includes first, second and third tubular housing sections; and first and second mandrels. The first tubular housing section is adapted to connect to a first tubing string segment; the second tubular housing section is adapted to connect to a second tubing string segment; the third tubular housing section disposed between the first and second tubular housing sections; the first mandrel forms a slidable connection with the first tubular housing section; and the second mandrel forms a slidable connection with the second tubular housing section.

17 Claims, 3 Drawing Sheets

(56) References Cited

U.S. PATENT DOCUMENTS

| | | | | |
|---|---|---|---|---|
| 2,961,219 | A * | 11/1960 | Le Bus, Sr. | E21B 17/06 175/321 |
| 3,947,008 | A * | 3/1976 | Mullins | E21B 17/07 267/125 |
| 5,069,488 | A * | 12/1991 | Freyer | E21B 19/006 166/355 |
| 5,441,111 | A | 8/1995 | Whiteford | |
| 8,869,887 | B2 * | 10/2014 | Deere | E21B 33/0385 166/242.6 |
| 2004/0016544 | A1 | 1/2004 | Braddick | |
| 2004/0216928 | A1 * | 11/2004 | Bauer | E21B 17/07 175/320 |
| 2006/0157253 | A1 | 7/2006 | Robichaux et al. | |
| 2012/0305315 | A1 | 12/2012 | Bedouet | |

OTHER PUBLICATIONS

International Preliminary Report on patentability issued in related PCT application PCT/US2015/051316, dated Mar. 28, 2017 (4 pages).

* cited by examiner

TELESCOPING SLIP JOINT ASSEMBLY

CROSS-REFERENCE TO RELATED APPLICATIONS

This application claims the benefit under 35 U.S.C. §119 (e) to U.S. Provisional Patent Application Ser. No. 62/053,307 entitled, "TELESCOPING SLIP JOINT," which was filed on Sep. 22, 2014, and is hereby incorporated by reference in its entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir.

SUMMARY

In an example embodiment, a slip joint assembly that is usable with a well includes first, second and third tubular housing sections; and first and second mandrels. The first tubular housing section is adapted to connect to a first tubing string segment; the second tubular housing section is adapted to connect to a second tubing string segment; the third tubular housing section disposed between the first and second tubular housing sections; the first mandrel forms a slidable connection with the first tubular housing section; and the second mandrel forms a slidable connection with the second tubular housing section.

In another example embodiment, a system that is usable with a well, includes a tubing string and a slip joint assembly, which is disposed in the tubing string to allow longitudinal expansion and contraction of the tubing string along a longitudinal axis of the assembly so that the string may change in length by up to a stroke of the assembly. The slip joint assembly includes a housing, a central portion, a first mandrel and a second mandrel. The first mandrel extends from the central portion into the housing in a first direction along the longitudinal axis to provide part of the stroke; and the second mandrel extends from the central portion into the housing in a second direction along the longitudinal axis to provide the remaining part of the stroke. The second direction is opposed to the first direction.

In yet another example embodiment, a technique that is usable with a well includes running a tubing string in the well and using a telescoping symmetrical slip joint in the tubing string to accommodate thermal expansion or contraction of tubing string material.

Other advantages and features will become apparent from the following drawings, description, and claims.

DETAILED DESCRIPTION

In the following description, numerous details are set forth to provide an understanding of the present disclosure. However, it will be understood by those skilled in the art that the embodiments of the present disclosure may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the disclosure.

Figure 1:
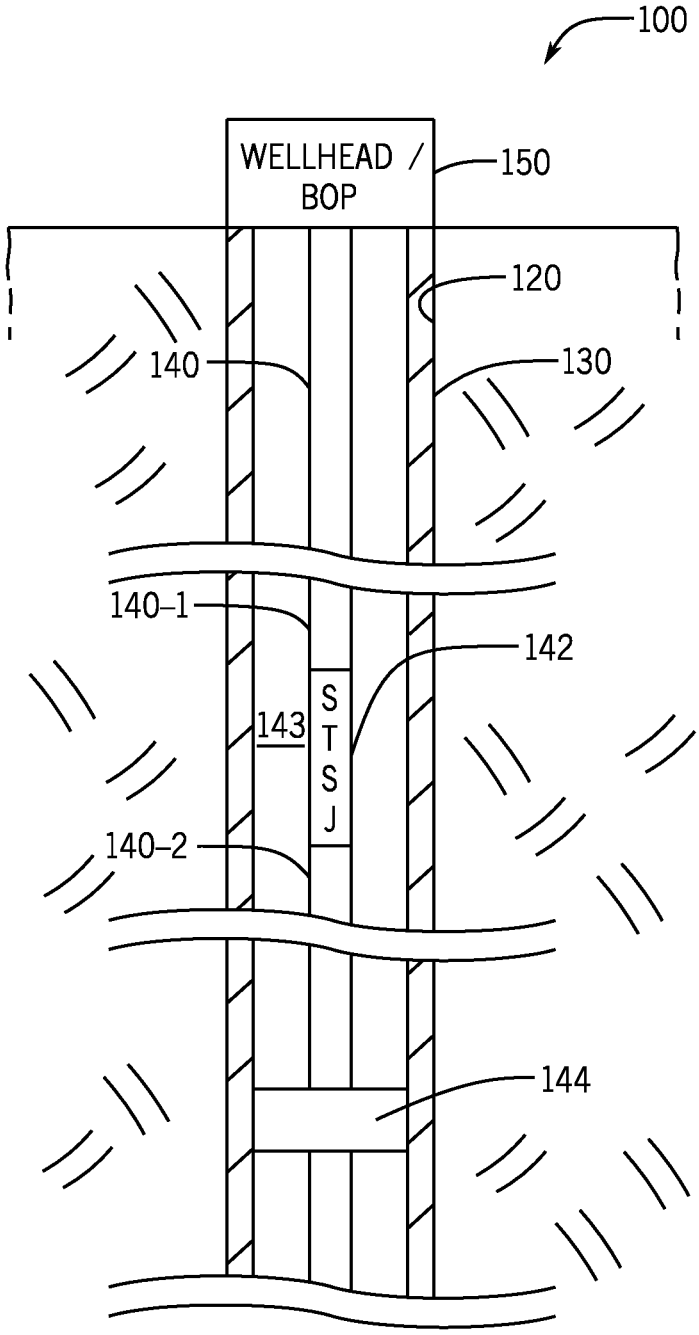
FIG. 1 is a schematic of a well-based system according an example implementation.

FIG. 1 generally depicts a well-based system 100, in accordance with example implementations. Referring to FIG. 1, a tubing string 140 may be run downhole in a wellbore 120 for purposes for performing various downhole functions. For example, the tubing string 140 may be a test string, which is run downhole inside a wellbore 120 for purposes of performing formation tests, pressure tests, and so forth, downhole inside the well. In accordance with further implementations, the tubing string 140 may be run downhole for purposes other than testing.

For the example implementation that is depicted in FIG. 1, the wellbore 120 is lined, or supported by, a casing string 130. However, in accordance with further example implementations, the wellbore 120 may not be cased. Moreover, although FIG. 1 depicts a vertical wellbore 120, the tubing string 140 may be deployed in a deviated or lateral wellbore.

Due to the well environment (downhole temperatures, downhole well fluids, fluids pumped downhole from the Earth surface, and so forth), the tubing string 140 may be subject to various temperature changes, which may, in turn, result in corresponding contraction and/or thermal expansion of the string 140. The tubing string 140 may be secured in position at one or more locations along its length. In this manner, as depicted in FIG. 1, the tubing string 140 may be secured in place at such locations as a downhole packer 144, at a well head and/or blowout preventer (BOP) 150, and so forth. Due the tubing string 140 being secured at such points, thermal expansion/contraction of the string 140 may result in tubing/equipment failure downhole.

For purposes of accommodating its expansion/contraction, the tubing string 140 may contain one or multiple slip joint assemblies, such as a symmetrical telescoping slip joint assembly 142 that is depicted in FIG. 1. For the example implementation depicted in FIG. 1, the slip joint assembly 142 connects an upper segment 140-1 of the tubing string 140 to a lower segment 140-2 of the string 142.

In general, a slip joint assembly, or slip joint, is used in a downhole string for purposes of allowing the string to extend and retract to compensate for thermal expansion and contraction of the string. In this manner, the slip joint has a stroke, which is the difference in length of the slip joint between its fully extended and fully contracted positions. As an example, a given slip joint may have a stroke of five to ten feet. The slip joint may also one or multiple sealing elements, which are constructed to isolate the interior of the slip joint (i.e., the interior passageway of the string) from the annulus outside of the slip joint (and string).

The slip joint may be pressure balanced, which means that the slip joint is constructed to be independent of a pressure differential between the inside and outside (or annulus) of the string. In other words, for a pressure balanced slip joint, the pressure differential between the outer and inner pressures of the string does not cause the slip joint to longitudinally contract or expand during normal operations. To achieve the pressure balance, a conventional slip joint may have a relatively intricate arrangement of parts, with several components of the slip joint serving the purposes of maintaining the pressure balance (or pressure independence) of the slip joint.

In accordance with example implementations that are disclosed herein, the symmetric telescoping slip joint assembly 142 has a construction that reduces its overall length (as compared to conventional slip joints), for a given stroke. In accordance with example implementations, the slip joint assembly 142 may provide the same stroke as a conventional slip joint but have an overall length that is one half of the length of a conventional slip joint. More specifically, as described herein, the slip joint assembly 142 takes advantage of its symmetric design: an upper portion of the assembly 142 provides one half of the stroke; and a lower portion of the assembly 142 provides the other half of the stroke. Moreover, due to the symmetric geometry of the slip joint assembly 142, the assembly 142 maintains a pressure balance between the interior of the assembly 142 and an annulus 143 of the assembly 142 by maintaining the same effective area (upon which the tubing and annulus pressures act) in opposing directions. Therefore, in accordance with example implementations, a change in the tubing-to-annulus pressure does not cause a change in the length of the slip joint assembly 142.

Figure 2:
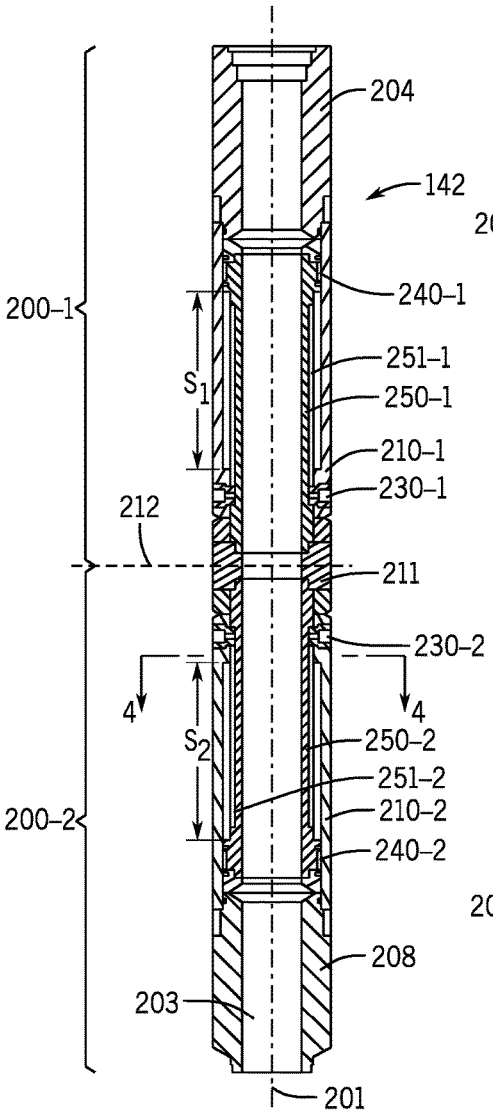
FIG. 2 is a cross-sectional view of a symmetric telescoping slip joint assembly of the tubing string of FIG. 1 illustrating the assembly in a fully refracted state according to an example implantation.

FIG. 2 depicts the symmetrical telescoping slip joint assembly 142, in accordance with example implementations. In particular, FIG. 2 depicts the slip joint assembly 142 in its fully refracted state. In general, the slip joint assembly 142 is symmetric about a plane 212 that longitudinally divides the assembly 142 into two telescoping portions: an upper telescoping portion 200-1 (called the "upper portion 200-1" herein); and a lower telescoping portion 200-2 (called the "lower portion 200-2" herein). In accordance with example implementations, the upper portion 200-1 is formed from components that are replicas of the components of the lower portion 200-2. As such, the same reference numeral is used to refer to replica components in both portions 200-1 and 200-2, with the suffix "1" being used to denote an actual component in the upper portion 200-1 and the suffix "2" being used to denote an actual component in the lower portion 200-2. For example, example, the slip joint assembly 142 contains a tubular housing section 210-1 that is part of the upper portion 200-1 and a housing section 210-2 that is a replica of the housing section 210-1 and is part of the lower portion 200-2. As depicted in FIG. 2, the plane 212 bisects a tubular, central housing section 211 of the slip joint assembly 142. Thus, the upper half of the housing section 211 is part of the upper portion 200-1, and the lower half of the housing section 211 is part of the lower portion 200-2.

The upper housing section 210-1 is concentric about a longitudinal axis 201 of the assembly 142. The upper housing section 210-1 is disposed above the central housing section 211 and moves with respect to the central housing section 211 along the longitudinal axis 201 to provide a stroke (called "S1" in FIG. 2) that is one half of the overall stroke for the assembly 142. The upper housing section 210-1 is connected at its upper end to the upper segment 140-1 (see FIG. 1) of the tubing string 140. In this manner, in accordance with example implementations, the upper end of the upper housing section 210-1 is connected to (as shown at reference numeral 240-1) to a tubular connector 204 (a female connector, for example), which, in turn couples the slip joint assembly 142 to the upper 140-1 segment of the tubing string 140 (see FIG. 1).

In a similar manner, a lower housing section 210-2 of the lower portion 200-2 of the slip joint assembly 142 is concentric about the longitudinal axis 201 of the assembly 142; is disposed below the central housing section 211 and moves with respect to the central housing section 211 to provide a stroke (called "S2" in FIG. 2), which is the other half of the overall stroke for the assembly 142. The lower housing section 210-2 is is connected to (as shown at reference numeral 240-2) to a tubular connector 208 (a male connector, for example), which, in turn couples the slip joint assembly 142 to the lower 140-2 segment of the tubing string 140 (see FIG. 1).

The central housing section 211 is a tubular body, which is concentric about the longitudinal axis 201 and is secured to both an upper mandrel 250-1 (part of the upper portion 200-1) and a lower mandrel 250-2 (part of the lower portion 200-2). The upper mandrel 250-1 is concentric about the longitudinal axis 201 and extends upwardly from the central housing section 211 into the upper housing section 210-1, which circumscribes at least part of the mandrel 250-1. Likewise, the lower mandrel 250-2 is concentric about the longitudinal axis 201 and extends downwardly from the central housing section 211 into the lower housing section 210-2, which circumscribes the mandrel 250-2.

The mandrel 250-1 and the upper housing section 210-1 form a telescoping slip connection for the upper portion 200-1; and likewise, the mandrel 250-2 and the lower housing section 210-2 form a telescoping slip connection for the lower portion 200-2. In this manner, the slip connection that is formed between the mandrel 250-1 and the upper housing section 210-1 provides the S1 stroke for the slip joint assembly 142; and the slip connection that is formed between the mandrel 250-2 and the lower housing section 210-2 provides the S2 stroke for the slip joint assembly 142. Due to the symmetry of the slip joint assembly 142, the overall stroke of the slip joint assembly 142 is the sum of the strokes S1 and S2.

The slip joint assembly 142 further contains sealing elements for purposes of forming fluid seals between the mandrels 250 and the corresponding housing sections 210. In accordance with example implementations, the interior of the upper housing section 210-1 contains a channel, or groove, that holds a sealing element 230-1 to form a pressure/fluid seal between the upper housing section 210-1 and the inner mandrel 250-1; and correspondingly, an interior channel of the lower housing section 210-2 contains a groove that holds a sealing element 230-2 to form a pressure/fluid seal between the lower housing section 210-2 and the inner mandrel 250-2. The seal 230 may be a chevron seal stack, in accordance with example implementations.

Figure 3:
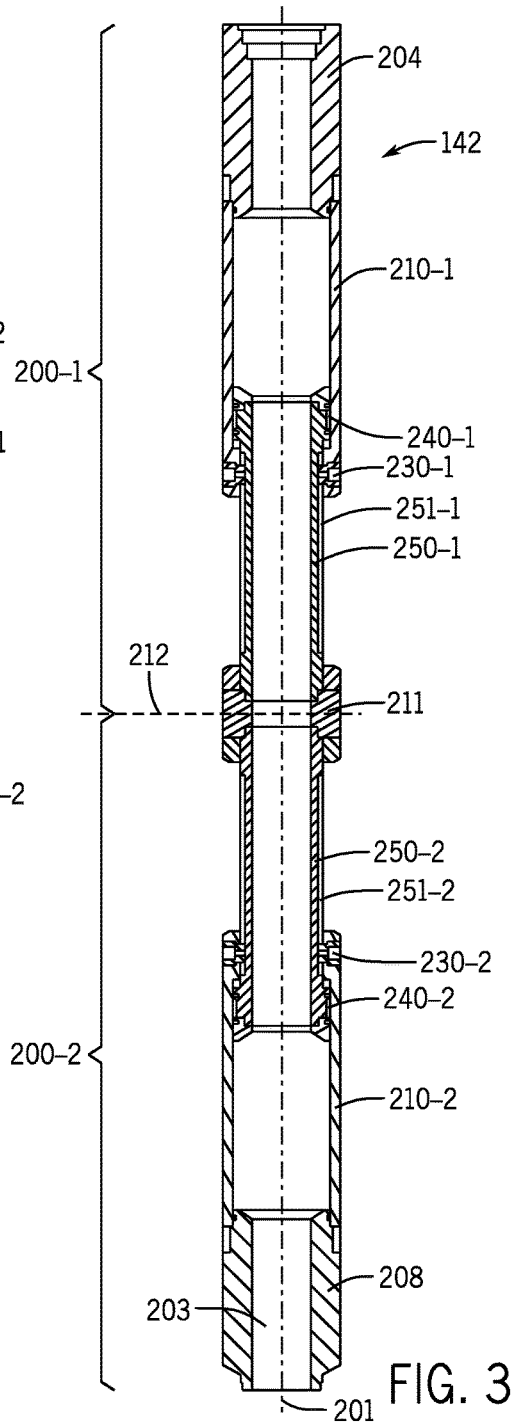
FIG. 3 is a cross-sectional view of the symmetric telescoping slip joint assembly in a fully extended state according an example implementation.

FIG. 2 depicts the slip joint assembly 142 in its fully retracted state, and FIG. 3 depicts the slip joint assembly 142 in its fully extended position. Although FIG. 3 depicts the extension of the slip joint assembly 142 as being divided equally between the upper 200-1 and lower 200-1 portions, in operation, the upper portion 200-1 of the slip joint assembly 142 extends and retracts along the longitudinal axis 201 independently from the lower portion 200-2. Therefore, in operation, the distance between the upper housing 210-1 and the central housing 211 may be different than the distance between the lower housing 210-2 and the central housing 211.

Figure 4:
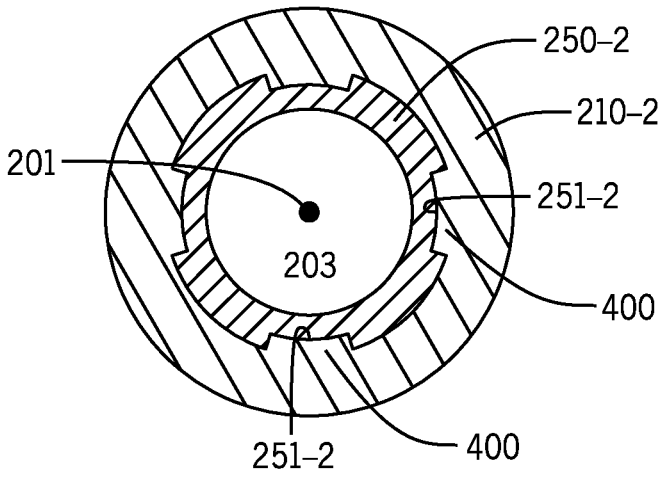
FIG. 4 is a cross-sectional view of the telescoping slip joint assembly taken along line 4-4 of FIG. 2 according to an example implementation.

As depicted by the cross section of FIG. 4, in accordance with some implementations, the inner mandrel 250 and outer housing 210 may be connected in a manner that allows a torque force to be transferred between these components. Such a torque force transfer allows a rotational force to be applied through the slip joint assembly 142 for purposes of rotating the tubing string 141 (see FIG. 1). In this manner, tubing string 141 may be rotated for purposes of setting the packer 144, releasing the packer 144, opening a downhole valve or performing other downhole operation.

In accordance with some implementations, the lower mandrel 250-2 (as an example) may have channels 251-2 that receive associated splines 400 of the housing section 210-2. For the example implementation of FIG. 4, four splines 400 and four associated channels 251-2 are shown. However, in accordance with further example implementations, the slip joint assembly 142 may contain more than four or fewer than four splines (and corresponding channels).

The engagement of the splines 400 with the channels 251-2 allow the transfer f a torque force between the inner mandrel 250-2 and the outer housing 210-2, while permitting longitudinal translation of the housing section 210-2 with respect to the mandrel 250-2. The upper mandrel 250-1 and upper housing section 210-1 may have a similar spline-based connection, in accordance with example implementations.

The mandrel 250 and the housing section 210 may be connected to allow a torque force connection using a connection other than a spline-based connection, in accordance with further example implementations.

Figure 5:
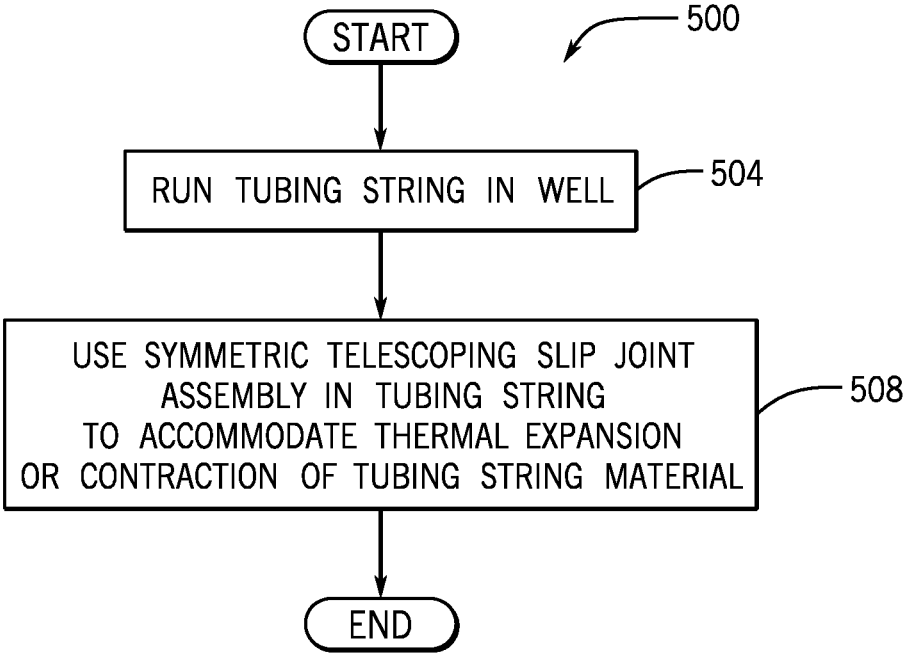
FIG. 5 is a flow diagram depicting a technique to accommodate thermal expansion and contraction in a tubing string according to an example implementation.

Referring to FIG. 5, thus, in accordance with example implementations, a technique 500 includes running (block 504) a tubing string in a well and using (block 508) a symmetric telescoping slip joint assembly in the tubing string to accommodate thermal expansion or contraction of tubing string material.

In accordance with example implementations, the telescoping symmetric slip joint assembly may have one or more of the following advantages. The reduction of length of the telescoping symmetric slip joint assembly, as compared to conventional slip joints, enhances handling of the slip joint assembly and reduces its overall manufacturing cost. The telescoping symmetric slip joint assembly may have fewer components than the conventional slip joint, thereby translating into lower manufacturing costs. Moreover, due to a lower number of components, the number of potential leak paths (sources of potential tool failure) may be reduced. Other and different advantages are contemplated, which are within the scope of the appended claims.

Other implementations are contemplated, which are within the scope of the appended claims. For example, in accordance with further implementations, a slip joint assembly may have a similar design to the slip joint assembly 142, except that the slip joint assembly is not symmetric about the plane 212. In this manner, the upper mandrel 250-1 and the upper housing section 210 may be longer than the lower mandrel 250-2 and lower housing section 210-1, or vice versa, to impart differences between the S1 and S2 strokes. As another variation, in accordance with further implementations, slip joint assembly may have a similar design to the slip joint assembly 142, except that the housing section sections 210-1 and 210-2 may be connected to the central housing section 211 (instead of being connected to the tubular connectors 204 and 208); and the mandrels 250-1 and 250-2 may be connected to the tubular connectors 204 and 208, respectively (instead of being connected to the central housing section 211).

While the present techniques have been described with respect to a number of embodiments, it will be appreciated that numerous modifications and variations may be applicable therefrom. It is intended that the appended claims cover all such modifications and variations as fall within the scope of the present techniques.

What is claimed is:

1. An apparatus usable with a well, comprising:

a first tubular housing section adapted to connect to a first tubing string segment;

a second tubular housing section adapted to connect to a second tubing string segment;

a third tubular housing section disposed between the first and second tubular housing sections;

a first mandrel secured to the third tubular housing section and configured to form a slidable connection with the first tubular housing section;

a second mandrel secured to the third tubular housing section and configured to form a slidable connection with the second tubular housing section; and a sealing element to form a continuous seal between the first tubular housing section and the first mandrel.

2. The slip joint assembly of claim 1, wherein:

the first mandrel extends into the first tubular housing section; and the second mandrel extends into the second tubular housing section.

3. The slip joint assembly of claim 1, further comprising:

a connection between the first tubular housing section and the first mandrel to transfer a torque force between the first tubular housing section and the first mandrel.

4. The slip joint assembly of claim 3, wherein the connection comprises a spline connection.

5. The slip joint assembly of claim 1, wherein the first mandrel extends in a first direction away from the third tubular housing section along a longitudinal axis of the slip joint assembly, the second mandrel extends in a second direction away from the third tubular housing section along the longitudinal axis, and the second direction is opposite from the first direction.

6. The slip joint assembly of claim 1, wherein:

the first tubular housing section, second tubular housing section, third tubular housing section, first mandrel and second mandrel form a slip joint associated with a stroke;

the slidable connection between the first tubular housing section and the first mandrel forms one half of the stroke; and the slidable connection between the second tubular housing section and the second mandrel forms one half of the stroke.

7. The slip joint assembly of claim 1, wherein:

the first tubular housing section, second tubular housing section, third tubular housing section, first mandrel and second mandrel form a slip joint; and the third tubular housing section is disposed near or at a center point of the slip joint.

8. The slip joint assembly of claim 1, wherein:

the first tubular housing section, second tubular housing section, third tubular housing section, first mandrel and second mandrel form a slip joint;

the first and second tubing segments form a least part of a tubing string having an inner passageway that is pressure isolated from a region outside of the tubing string; and the slip joint is pressure balanced such that changes in a pressure between the inner passageway and the region outside of the tubing string do not cause expansion or contraction of the slip joint.

9. The slip joint assembly of claim 1, wherein:

the first and second tubing segments form a least part of a tubing string having an inner passageway that is pressure isolated from a region outside of the tubing string; and the first tubular housing section, second tubular housing section, third tubular housing section, first mandrel and second mandrel form a slip joint adapted to expand and contract due to thermal expansion and contraction of the tubing string.

10. The slip joint assembly of claim 1, wherein the first mandrel and the second mandrel have the same dimensions.

11. A system usable with a well, comprising:

a tubing string; and a slip joint assembly disposed in the tubing string to allow longitudinal expansion and contraction of the tubing string along a longitudinal axis of the assembly so that the string may change in length by up to a stroke of the assembly, the slip joint assembly comprising:

a central portion;

an upper housing connected to the central portion;

a lower housing connected to the central portion;

a first mandrel connected to a first tubing string segment and configured to extend into the upper housing in a first direction along the longitudinal axis to provide part of the stroke;

a sealing element to form a continuous seal between the upper housing and the first mandrel; and a second mandrel connected to a second tubing string segment and configured to extend into the housing in a second direction along the longitudinal axis to provide the remaining part of the stroke, wherein the second direction is opposed to the first direction.

12. The system of claim 11, wherein the slip joint assembly is symmetrical about the central portion.

13. The system of claim 12, wherein the symmetry causes the slip joint assembly to be independent of a pressure difference between an annulus of the tubing string and an interior of the tubing string.

14. A method usable with a well, comprising:

running a tubing string in the well;

using a telescoping symmetrical slip joint in the tubing string to accommodate thermal expansion or contraction of tubing string material; and using mandrels sections that are secured to a central housing and that extend into corresponding housing sections of the slip joint to form corresponding slidable connections and providing a sealing element to form a continuous seal between a tubular housing section of the telescoping symmetrical slip joint and the mandrels.

15. The method of claim 14, wherein using the symmetrical slip joint comprises:

providing part of a stroke of the slip joint uphole of a center point of symmetry of the slip joint; and providing the remaining part of the stroke of the slip joint downhole of the center point of symmetry.

16. The method of claim 14, wherein:

providing part of the stroke of the slip joint uphole of the center point comprise providing a first stroke; and providing the remaining part of the stroke of the slip joint downhole of the center point comprises providing a second stroke different from the first stroke.

17. The method of claim 16, further comprising:

transferring a torque force between the mandrels and the housing sections.

* * * * *